US006789536B1

(12) United States Patent
Summers

(10) Patent No.: US 6,789,536 B1
(45) Date of Patent: Sep. 14, 2004

(54) DROP AWAY ARROW REST SYSTEM

(76) Inventor: Daniel A. Summers, 455 Ambrose Rucker Rd., Monroe, VA (US) 24574

( * ) Notice: Subject to any disclaimer, the term of this patent is extended or adjusted under 35 U.S.C. 154(b) by 0 days.

(21) Appl. No.: 10/758,519

(22) Filed: Jan. 15, 2004

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 5,394,858 A * 3/1995 Karolian ..... 124/44.5
6,044,832 A * 4/2000 Piersons, Jr. ..... 124/44.5
6,202,635 B1 * 3/2001 Evans ..... 124/44.5
6,520,170 B1 * 2/2003 Adkins ..... 124/44.5
6,615,813 B1 * 9/2003 Troncoso et al. ..... 124/44.5

* cited by examiner

*Primary Examiner*—John A. Ricci
(74) *Attorney, Agent, or Firm*—Edward P. Dutkiewicz

(57) ABSTRACT

A housing has a hollow interior with coupling components for releasably coupling the housing to a bow. A shaft has an interior segment and an exterior segment. The interior segment is rotatably supported within the housing. A generally Y-shaped launcher has a downwardly extending arm and two laterally spaced upwardly extending arms. The downwardly extending arm has an aperture receiving the exterior segment of the shaft for the rotation of the launcher. A thumbwheel is mounted on the interior component of the shaft for rotation by the user to rotate the shaft and launcher to an intermediate orientation. A cord has a first end. The first end is secured to the thumbwheel for rotating the thumbwheel. A second end is coupled to the string. Pulling the string will rotate the shaft and launcher to an essentially vertical orientation.

11 Claims, 6 Drawing Sheets

FIG 1
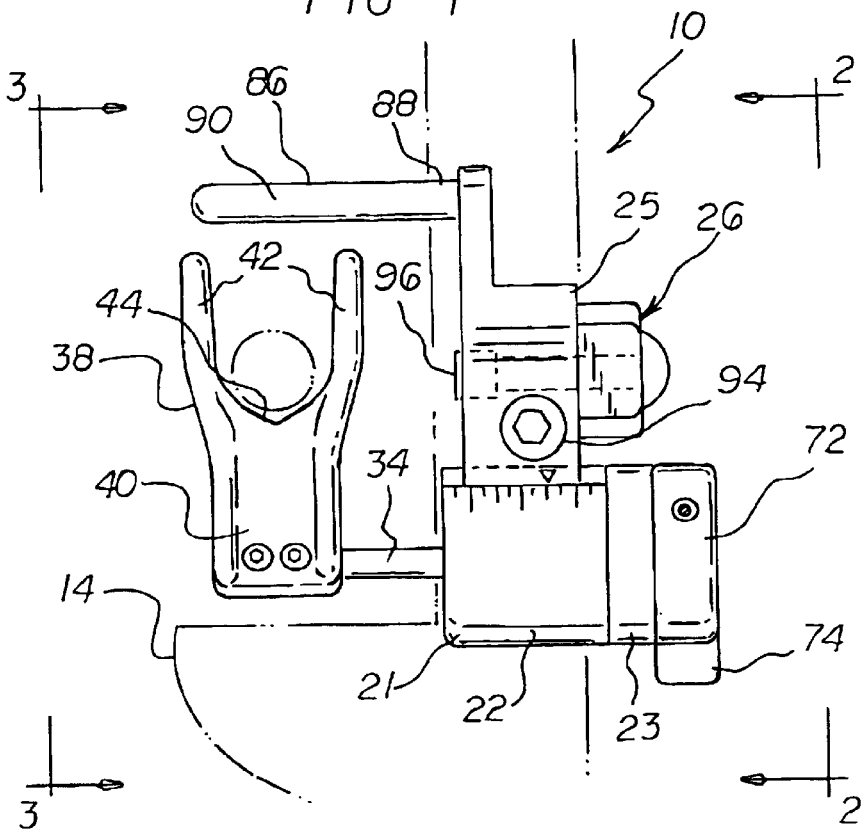
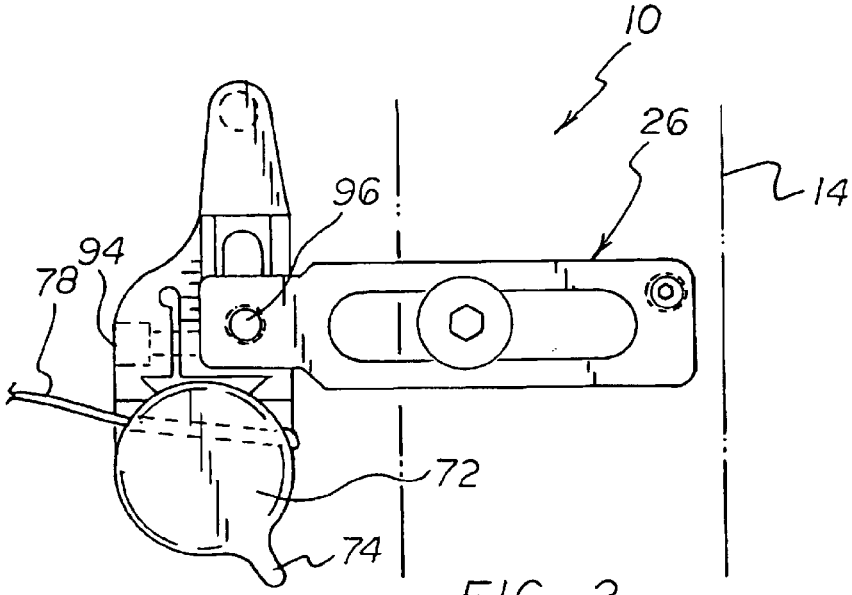
FIG 2

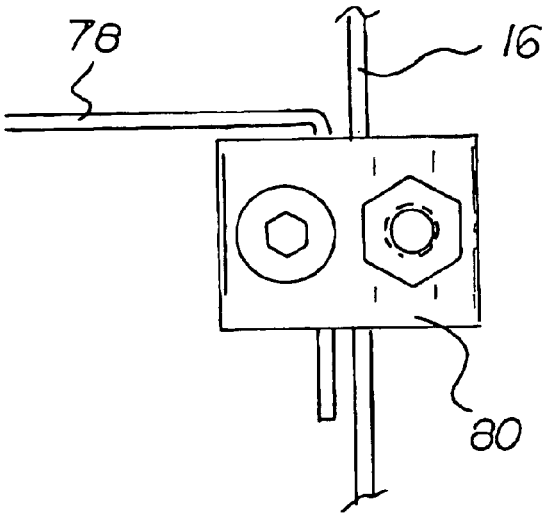
FIG 5
FIG 6
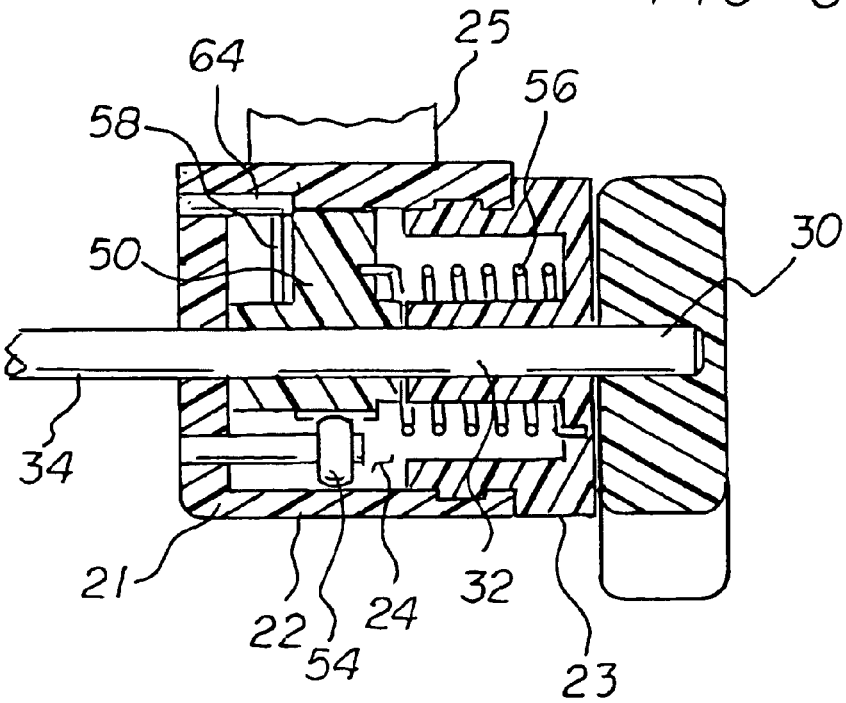

DROP AWAY ARROW REST SYSTEM

BACKGROUND OF THE INVENTION

1. Field of the Invention

The present invention relates to a drop away arrow rest system and more particularly pertains to assuring that an arrow and its components have total bow shelf clearance during drawing a bow or during left down and for assuring arrow rest only drops away when the bow is fired while assuring the arrow rest fully captures the arrow when loaded until fired.

2. Description of the Prior Art

The use of fall away arrow rests of known designs and configurations is known in the prior art. More specifically, arrow rests of known designs and configurations previously devised and utilized for the purpose of falling away to preclude drag are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,865,007 issued Sep. 12, 1989 to Saunders relates to a fall-away arrow rest assembly. U.S. Pat. No. 6,044,8432 issued Apr. 4, 2000 to Piersons relates to a fallaway arrow rest assembly. Lastly, U.S. Pat. No. 6,615,813 issued Sep. 9, 2003 to Troncoso relates to a fallaway arrow rest.

While these devices fulfill their respective, particular objectives and requirements, the aforementioned patents do not describe drop away arrow rest system that allows assuring total bow shelf clearance during drawing a bow or during left down and for assuring arrow rest only drops away when the bow is fired while assuring the arrow rest fully captures the arrow when loaded until fired.

In this respect, the drop away arrow rest system according to the present invention substantially departs from the conventional concepts and designs of the prior art, and in doing so provides an apparatus primarily developed for the purpose of assuring total bow shelf clearance during drawing a bow or during left down and for assuring arrow rest only drops away when the bow is fired while assuring the arrow rest fully captures the arrow when loaded until fired.

Therefore, it can be appreciated that there exists a continuing need for a new and improved drop away arrow rest system which can be used for assuring total bow shelf clearance during drawing a bow or during left down and for assuring arrow rest only drops away when the bow is fired while assuring the arrow rest fully captures the arrow when loaded until fired. In this regard, the present invention substantially fulfills this need.

SUMMARY OF THE INVENTION

In view of the foregoing disadvantages inherent in the known types of fall away arrow rests of known designs and configurations now present in the prior art, the present invention provides an improved drop away arrow rest system. As such, the general purpose of the present invention, which will be described subsequently in greater detail, is to provide a new and improved drop away arrow rest system and method which has all the advantages of the prior art and none of the disadvantages.

To attain this, the present invention essentially comprises a compound bow. The compound bow has a string. The compound bow has an arrow. The arrow is adapted to be shot in a path of travel from the bow by pulling and releasing the string.

A housing is provided. The housing has a hollow interior. The housing has coupling components. In this manner the housing may be coupled to the bow.

Provided next is a shaft. The shaft has an interior segment. The interior segment is rotatably supported within the housing. The shaft has an exterior segment. The exterior segment extends exterior of the housing beneath the arrow and transverse to its path of travel.

A generally Y-shaped launcher is provided next. The Y-shaped launcher has a downwardly extending arm. The Y-shaped launcher also has two laterally spaced upwardly extending arms. The arms extend essentially vertically. The arrow is positioned between the arms when firing the arrow. The launcher provides a V-shaped surface. The V-shaped surface supports the arrow during the drawing of the bow and the release of the string. The downwardly extending arm has an aperture. The aperture receives the exterior segment of the shaft for the rotation of the launcher concurrent with the rotation of the shaft.

An oscillator is provided within the housing rotatably mounted on the shaft with an arcuate recess of about 90 degrees. The recess has arcuate ends. A rubber bumper stop is within the housing between the ends of the recess fixedly supported by the housing adjacent to the launcher to limit the rotation of the oscillator. One end of the oscillator has a protruding finger to function as a deceleration node which latches on a stop pin to prevent bounce back of the launcher when the launcher drops at full velocity. A coil spring with a first end is fixedly coupled to the end cap remote from the launcher and a second end is coupled to the oscillator to rotate and drop the launcher when firing an arrow. A dog is mounted on a pivot pin secured to the oscillator. The dog has a head functioning as a spring with a fixed intermediate locking pin co-operable with the head to hold the oscillator and launcher in the intermediate orientation. The dog has a tail functioning with a fixed ramp pin co-operable with the tail, to rotate counterclockwise and hold the dog when the oscillator and launcher are rotated to the vertical or firing orientation.

Next provided is a thumbwheel. The thumbwheel is mounted on the end of the shaft remote from the launcher for rotation there with. The thumbwheel has a radially enlarged segment for rotation by the user to rotate the shaft and launcher to the intermediate orientation between the essentially horizontal orientation and the essentially vertical orientation.

A cord is provide next. The cord has a first end secured to the thumbwheel and a second end with a bracket coupled between the string and the cord. In this manner, pulling the string will pull the cord and rotate the thumbwheel and shaft and launcher to an essentially vertical orientation from an intermediate orientation. Further, release of the string will rotate the shaft and launcher from the essentially vertical orientation to the horizontal orientation.

Further provided is a horizontal bar. The horizontal bar has a fixed end. The fixed end is secured to the vertical component. The fixed end has an intermediate region. The intermediate region is positioned over and in proximity to the upper arms of the launcher. In this manner an arrow on the launcher is prevented from falling away.

Provided last is a horizontal clamping screw and a vertical clamping screw. The horizontal clamping screw and the vertical clamping screw are operatively coupled between the housing and the launcher to accommodate fine tuning of the rest for optimum arrow flight.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drop away arrow rest system which has all of the advantages of the prior art fall away arrow rests of known designs and configurations and none of the disadvantages.

It is another object of the present invention to provide a new and improved drop away arrow rest system which may be easily and efficiently manufactured and marketed.

It is further object of the present invention to provide a new and improved drop away arrow rest system which is of durable and reliable constructions.

An even further object of the present invention is to provide a new and improved drop away arrow rest system which is susceptible of a low cost of manufacture with regard to both materials and labor, and which accordingly is then susceptible of low prices of sale to the consuming public, thereby making such drop away arrow rest system economically available to the buying public.

Even still another object of the present invention is to provide a drop away arrow rest system for assuring total bow shelf clearance during drawing a bow or during left down and for assuring drop away of arrow rests at full spring tension velocity only when the bow is fired.

Lastly, it is an object of the present invention to provide a new and improved drop away rest system. A housing has a hollow interior with coupling components for releasably coupling the housing to a bow. A shaft has an interior segment and an exterior segment. The interior segment is rotatably supported within the housing. A generally Y-shaped launcher has a downwardly extending arm and two laterally spaced upwardly extending arms. The downwardly extending arm has an aperture receiving the exterior segment of the shaft for the rotation of the launcher. A thumbwheel is mounted on the interior component of the shaft for rotation by the user to rotate the shaft and launcher to an intermediate orientation. A cord has a first end. The first end is secured to the thumbwheel for rotating the thumbwheel. A second end is coupled to the string. Pulling the string will rotate the shaft and launcher to an essentially vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a drop away arrow rest system constructed in accordance with the principles of the present invention.

FIG. 2 is a right side elevational view of the system taken along line 2—2 of in FIG. 1.

FIG. 5 is an enlarged view taken at circle 5 of FIG. 4 showing the cord and string coupled by a bracket.

FIG. 6 is a cross sectional view taken through the housing and axially through the shaft.

The same reference numerals refer to the same parts throughout the various Figures.

DESCRIPTION OF THE PREFERRED EMBODIMENT

Figure 3:
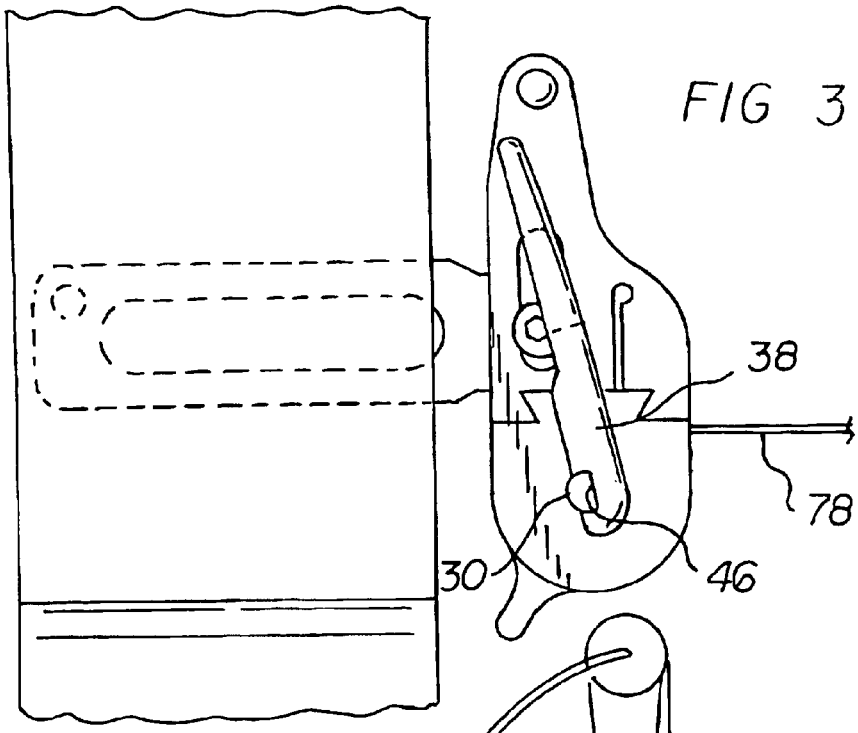
FIG. 3 is a left side elevational view of the system taken along line 3—3 of in FIG. 1 with the launcher in the intermediate orientation.
Figure 4:
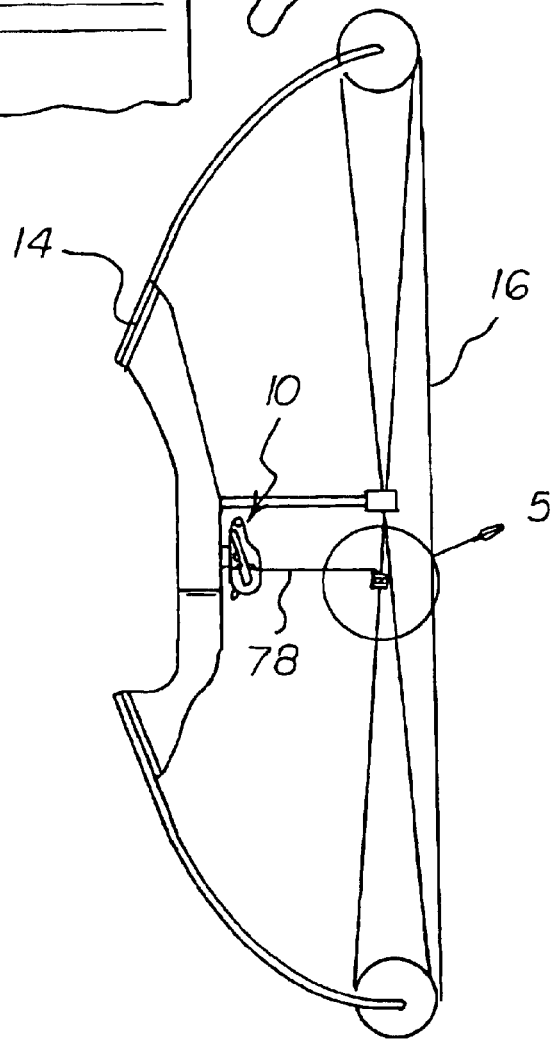
FIG. 4 is a side elevational view of a bow and arrow with the drop away arrow rest system of the present invention.
Figure 9:
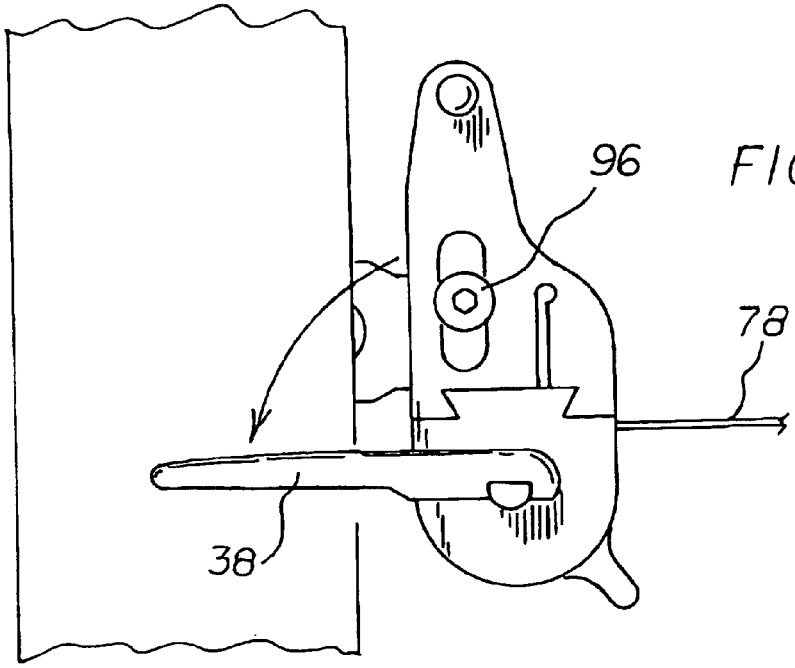
FIG. 9 is an enlarged side elevational view taken at circle 8 of FIG. 7 but showing the housing with the launcher in a horizontal orientation after firing.
Figure 3A:
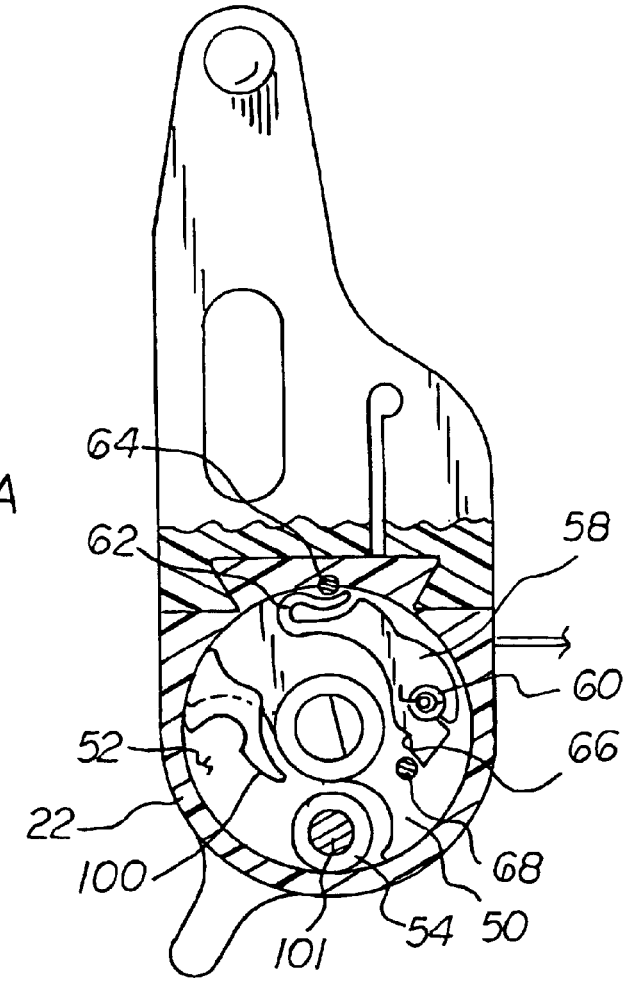
FIG. 3A is a cross sectional view through the housing with the launcher in the intermediate orientation.
Figure 7:
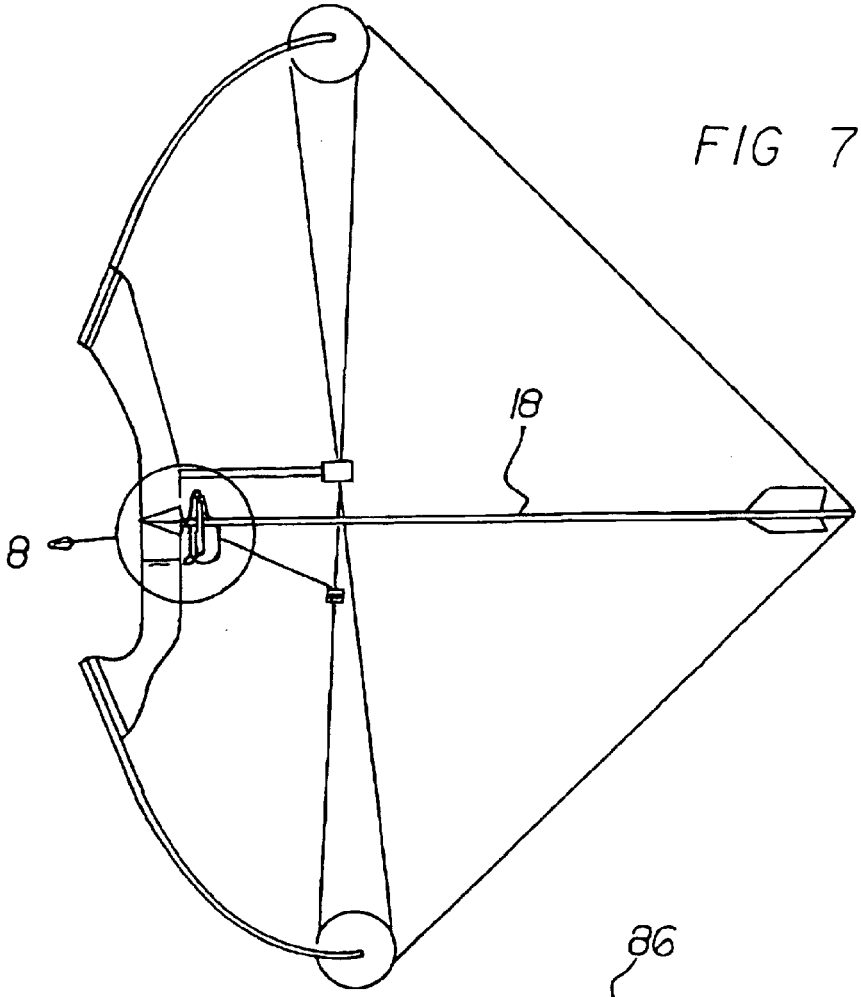
FIG. 7 is a side elevational view similar to FIG. 4 but with the string drawn prior to firing.
Figure 8:
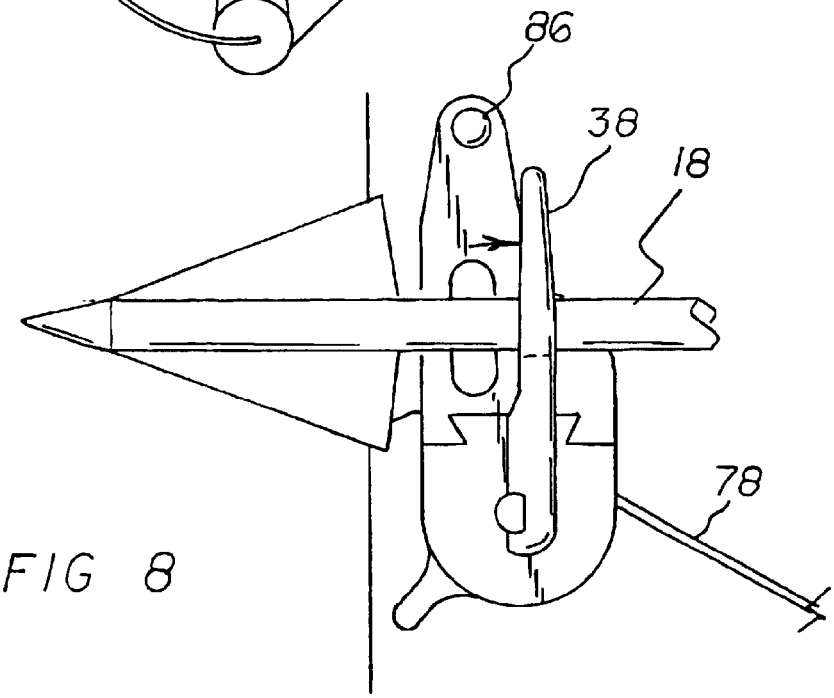
FIG. 8 is an enlarged side elevational view taken at circle 8 of FIG. 7 showing the housing with the launcher in a vertical orientation prior to firing.
Figure 8A:
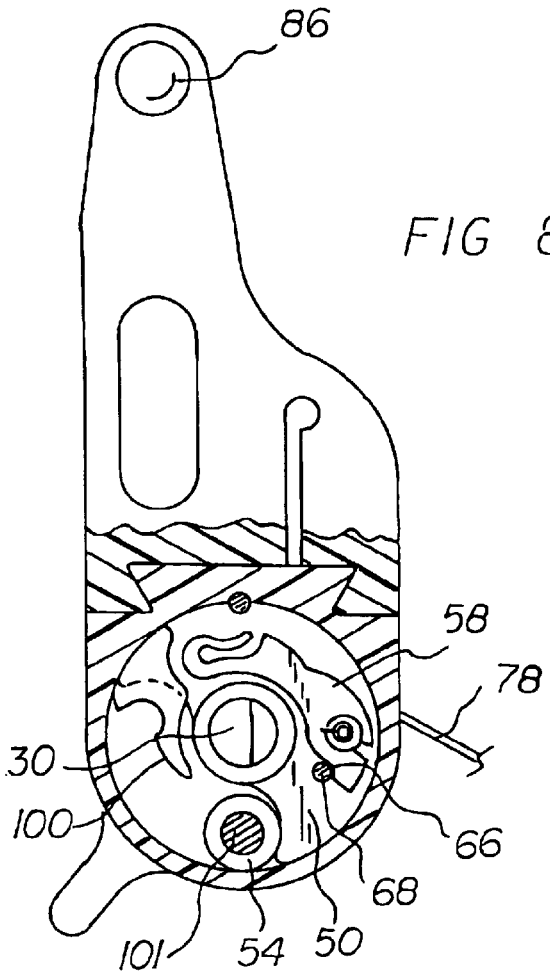
FIG. 8A is a cross sectional view through the housing with the launcher in the vertical orientation.
Figure 9A:
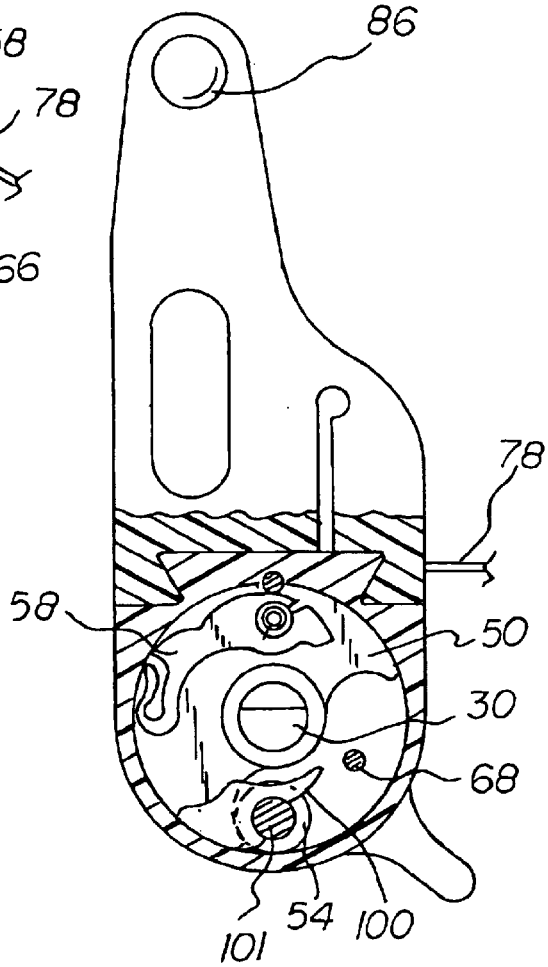
FIG. 9A is a cross sectional view through the housing with the launcher in the horizontal orientation.

With reference now to the drawings, and in particular to FIG. 1 thereof, the preferred embodiment of the new and improved drop away arrow rest system embodying the principles and concepts of the present invention and generally designated by the reference numeral 10 will be described.

The present invention, the drop away arrow rest system 10 is comprised of a plurality of components. Such components in their broadest context include a housing, a shaft, a generally Y-shaped launcher, a thumbwheel and a cord. Such components are individually configured and correlated with respect to each other so as to attain the desired objective.

First provided is a compound bow 14. The compound bow has a string 16. The compound bow has an arrow 18. The arrow is adapted to be shot in a path of travel from the bow by pulling and releasing the string.

A housing 22 is provided. The housing has a hollow interior 24. The housing has coupling components 26. In this manner the housing may be coupled to the bow.

Provided next is a shaft 30. The shaft has an interior segment 32. The interior segment is rotatably supported within the housing. The shaft has an exterior segment 34. The exterior segment extends exterior of the housing beneath the arrow and transverse to its path of travel.

A generally Y-shaped launcher 38 is provided next. The Y-shaped launcher has a downwardly extending arm 40. The Y-shaped launcher also has two laterally spaced upwardly extending arms 42. The arms extend essentially vertically. The arrow is positioned between the arms when the arrow is loaded and until it is fired. The launcher provides a V-shaped surface 44. The V-shaped surface supports the arrow during the drawing of the bow and the release of the string. The downwardly extending arm has an aperture 46. The aperture receives the exterior segment of the shaft for the rotation of the launcher concurrent with the rotation of the shaft.

An oscillator 50 is located within the housing. It is rotatably mounted on the shaft with an arcuate recess 52 of about 90 degrees. The recess has arcuate ends. A rubber bumper stop 54 is located within the housing between the ends of the recess. The bumper stop is fixedly supported by the housing adjacent to the launcher. The bumper stop acts to limit the rotation of the oscillator. One end of the oscillator has a protruding finger 100 to function as a deceleration node and latches on a stop pin 101 to prevent bounce back of the launcher when the launcher drops at full velocity. A coil spring 56 has a first end fixedly coupled to the end cap 23, the component of the housing remote from the launcher, and a second end coupled to the oscillator. Such coil spring acts to rotate and drop the launcher when firing an arrow. A dog 58 is mounted on a pivot pin 60 secured to the oscillator. The dog has a head 62 functioning as a spring with a fixed intermediate locking pin 64 co-operable with the head to hold the oscillator and launcher in the intermediate orientation. The dog also has a tail 66 functioning with a fixed ramp pin 68 co-operable with the tail, to rotate counterclockwise and hold the dog 58 when the oscillator and launcher are rotated to the vertical or firing orientation.

The dog is preferably fabricated of spring steel and of a configuration which has a break away feature whereby if an arrow is shot through the launcher and the timing is incorrect by improper installation, then the dog will spring and allow the launcher to drop away without damage.

Next provided is a thumbwheel 72. The thumbwheel 72 is mounted on the end of the shaft remote from the launcher for rotation there with. The thumbwheel has a radially enlarged segment 74 for rotation by the user to rotate the shaft and launcher to the intermediate orientation between the essentially horizontal orientation and the essentially vertical orientation.

A cord 78 is next provided. The cord has a first end secured to the thumbwheel and a second end with a bracket 80 coupled between the string and the cord. In this manner, pulling the string will pull the cord and rotate the thumbwheel and shaft and launcher to an essentially vertical orientation from an intermediate orientation. Further, release of the string will rotate the shaft and launcher from the essentially vertical orientation to the horizontal orientation.

Further provided is a horizontal bar 86. The horizontal bar has a fixed end 88. The fixed end is secured to the vertical component 25 of the housing. The fixed end has an intermediate region 90. The intermediate region is positioned over and in proximity to the upper arms of the launcher. In this manner an arrow on the launcher is prevented from falling away and remains captured when hunting, drawing or during slow let down.

Provided last is a horizontal clamping screw 94 and a vertical clamping screw 96. The horizontal clamping screw and the vertical clamping screw are operatively coupled between the housing and the launcher to accommodate fine tuning of the rest for optimum arrow flight.

No other arrow rest can shoot a shorter arrow, up to four inches shorter than the competition. Further, precision machined aluminum components, internal rubber bumpers and laser cut felt offer superior quality and noise reduction.

While drop away arrow rests are not new to the sport, the present invention boasts many unique designs.

The present invention incorporates Velocity Dropaway Technology, VDT. Using technology, the launcher only drops away when the bow is fired at which time the rest is allowed to drop away at a full spring tension, a rapid velocity without sufficient hindrance by the cord to allow the dog to catch on a locking pin.

As the arrow is loaded with the right hand, the launcher which supports the arrow is rotated up or clockwise via the thumbwheel, preferably with the left thumb, and comes to a stop at the fully vertical position when the wheel hits the rubber bumpers, o-rings. As the thumbwheel is released the dog, which is spring loaded to rotate up or clockwise, catches on a dowel pin. This stops the downward rotation of launcher at approximately 15 degrees from the vertical position. This is the ready position which supports the arrow while waiting for the bow to be drawn and while the vertical arms on the launcher keep the arrow from falling off.

As the bow is drawn, a cord which is attached to the thumbwheel on one end and the downward moving buss cable on the other becomes taut. This rotates the launcher and all attached parts to the fully vertical position again.

In scenario 1, if the bow is fired, the cord becomes loose. The main spring forces the launcher down or counter clockwise. The dog is allowed to raise but the velocity of the rotation of the launcher causes the dog to pass the dowel pin allowing the launcher to completely drop away so that arrow passes unobstructed.

In scenario 2, if the bow is let down slowly, the cord loosens. The main spring forces the launcher down or counterclockwise. The dog is allowed to raise and the slower velocity of the rotation of the launcher allows the dog to catch on the dowel pin. The launcher stops at approximately 15 degrees from vertical at the ready position.

The dog is designed of spring steel and of a configuration which has a break away feature. If an arrow is shot through the launcher and the timing is incorrect by improper installation, the dog will spring and allow the launcher to drop away without damage.

The guard or top bar and the long vertical extensions of launcher totally capture the arrow. With an arrow loaded the bow can be rotated upside down, even at full draw, without the arrow falling off the rest.

Further the guard is removably pressed vertical so they become one member. This maintains the distance from guard and launcher which keeps the arrow captured even when the vertical adjustment of the rest if altered.

At full draw the launcher is fully vertical. This offers higher repeatability as the arrow contact point is directly vertical of its pivot point, the axial center of the shaft. Therefore, any fluctuations of the launcher stopping point, results in less vertical arrow position change.

The present invention also allows shorter arrows to be used because the bow string when shot can reach closer to the arrow rest contact point without contacting the rest.

The arrow support of the present invention, at full draw, is at 12:00 in relation to the center of the shaft, compared to 10:00 to 11:00 of other previous designs. Thus, with the arrow rest overdrawn, adjusted toward the bowstring, as far as possible, the bowstring will not travel forward and contact the shaft when fired. The arrow may be shortened about 1 inch or so, plus or minus, so the broadhead is just past the arrow support, the launcher.

Other drop-away rests drag the arrow on the bow shelf and the arrow support only raises the arrow to the firing position at the very last part of the draw when the cord becomes taut. Therefore, as the broadhead is a much larger diameter than the arrow shaft which is dragging across the bow shelf, there is contact between the broadhead and the bow shelf. Thus, on these prior designs the arrow has to be long enough about 4 inches to about 5 inches so at full draw the broadhead extends past the bow shelf or the bow riser.

There is no other arrow rest wherein the launcher rotates on a shaft and rotates to full vertical position, i.e., the arrow support is vertical of its pivot point. Further, no other drop away rest is activated via the movement of the bow during the draw cycle and only drops away when the bow is fired. In addition, no other drop away rest totally captures the arrow from the time the arrow is loaded until it is fired or manually removed. Lastly, no other drop away arrow rest has an anti-bounce-back feature.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drop away arrow rest system for assuring total bow shelf clearance during drawing a bow or during let down and for assuring drop away of the arrow rest only when the bow is fired, and assuring that the arrow rest fully captures the arrow when loaded until fired, the system comprising, in combination:

a compound bow with a string and with an arrow adapted to be shot in a path of travel from the bow by the pulling and releasing of the string;

a housing having a hollow interior with coupling components for releasably coupling the housing to the bow;

a shaft with an interior segment rotatably supported within the housing, the shaft having an exterior segment extending exterior of the housing beneath the arrow and transverse to its path of travel;

a generally Y-shaped launcher having a downwardly extending arm and two laterally spaced upwardly extending arms, the arms extending essentially vertically with the arrow there between when firing the arrow, the launcher providing a V-shaped surface for supporting the arrow during the drawing of the bow and the release of the string, the downwardly extending arm having an aperture receiving the exterior segment of the shaft for the rotation of the launcher concurrent with the rotation of the shaft;

an oscillator within the housing rotatably mounted on the shaft with an arcuate recess of about 90 degrees, the recess having arcuate ends, a rubber bumper stop within the housing between the ends of the recess fixedly supported by the housing adjacent to the launcher to limit the rotation of the oscillator, one end of the oscillator having a protruding finger to function as a deceleration node which latches on a stop pin to prevent bounce back of the launcher when the launcher drops at full velocity, a coil spring with a first end fixedly coupled to the end cap remote from the launcher and a second end coupled to the oscillator to rotate and drop the launcher when firing an arrow, a dog mounted on a pivot pin secured to the oscillator, the dog having a head functioning as a spring with a fixed intermediate locking pin co-operable with the head to hold the oscillator and launcher in the intermediate orientation, the dog having a tail functioning with a fixed ramp pin co-operable with the tail, to rotate counterclockwise and hold the dog when the oscillator and launcher are rotated to the vertical or firing orientation;

a thumbwheel mounted on the end of the shaft remote from the launcher for rotation there with, the thumbwheel having a radially enlarged segment for rotation by the user to rotate the shaft and launcher to the intermediate orientation between the essentially horizontal orientation and the essentially vertical orientation;

a cord having a first end secured to the thumbwheel and a second end with a bracket coupled between the string and the cord whereby pulling the string will pull the cord and rotate the thumbwheel and shaft and launcher to an essentially vertical orientation from an intermediate orientation and whereby release of the string will rotate the shaft and launcher from the essentially vertical orientation to the horizontal orientation;

a horizontal bar having a fixed end secured to the vertical component and having an intermediate region positioned over and in proximity to the upper arms of the launcher to preclude an arrow on the launcher from falling away; and a horizontal clamping screw and a vertical clamping screw operatively coupled between the housing and the launcher to accommodate fine tuning of the rest for optimum arrow flight.

2. A drop away arrow rest system comprising:

a housing having a hollow interior with coupling components for releasably coupling the housing to a bow;

a shaft with an interior segment rotatably supported within the housing and an exterior segment;

a generally Y-shaped launcher having a downwardly extending arm and two laterally spaced upwardly extending arms, the downwardly extending arm having an aperture receiving the exterior segment of the shaft for the rotation of the launcher;

a thumbwheel mounted on the interior component of the shaft for rotation there with for rotation by the user to rotate the shaft and launcher to an intermediate orientation; and a cord having a first end secured to the thumbwheel for rotating the thumbwheel and a second end coupled to the string whereby pulling the string will rotate the shaft and launcher to an essentially vertical orientation.

3. The system as set forth in claim 2 and further including an oscillator within the housing rotatably mounted on the shaft with an arcuate recess of about 90 degrees, the recess having arcuate ends, a rubber bumper stop within the housing between the ends of the recess fixedly supported by the housing adjacent to the launcher to limit the rotation of the oscillator, one end of the oscillator having a protruding finger to function as a deceleration node as the launcher drops away and reaches the horizontal position, a coil spring with a first end fixedly coupled to the end cap remote from the launcher and a second end coupled to the oscillator to rotate and drop the launcher when firing an arrow, a dog mounted on a pivot pin secured to the oscillator, the dog having a head functioning as a spring with a fixed intermediate locking pin co-operable with the head to hold the oscillator and launcher in the intermediate orientation, the dog having a tail functioning with a fixed ramp pin co-operable with the tail, to rotate counterclockwise and hold the dog when the oscillator and launcher are rotated to the vertical or firing orientation.

4. The system as set forth in claim 2 and further including a horizontal bar having a fixed end secured to a vertical component of the housing and having an intermediate region positioned over and in proximity to the upper arms of the launcher to preclude an arrow on the launcher from falling away.

5. The system as set forth in claim 2 and further including a horizontal clamping screw and a vertical clamping screw operatively coupled between the housing and the launcher to accommodate fine tuning of the rest for optimum arrow flight.

6. The system as set forth in claim 2 wherein the launcher rotates with a shaft and rotates to full vertical position, vertical of its pivot point.

7. The system as set forth in claim 2 wherein the drop away rest and launcher is activated via the movement of the bow during the draw cycle and only drops away when the bow is fired.

8. The system as set forth in claim 2 wherein the drop away launcher and associated components totally captures the arrow from the time the arrow is loaded until it is either fired or manually removed.

9. The system as set forth in claim 2 and further including an anti-bounce-back feature after firing.

10. The system as set forth in claim 2 and further including a dog fabricated of spring steel and of a configuration which has a break away feature whereby if an arrow is shot through the launcher and the timing is incorrect by improper installation, then the dog will spring and allow the launcher to drop away without damage.

11. The system as set forth in claim 2 and further including velocity dropaway technology wherein the launcher only drops away when the bow is fired at which time the rest is allowed to drop away at a full spring tension, a rapid velocity without sufficient hindrance by the cord to allow the dog to catch on a locking pin.

* * * * *